US005826449A

United States Patent [19]

Dupuis et al.

[11] Patent Number: 5,826,449

[45] Date of Patent: Oct. 27, 1998

[54] ELECTRICAL IGNITION KEY ASSEMBLY

[75] Inventors: Alain Dupuis, Jouy le Moutier; Jacques Laquerbe, Sartrouville, both of France

[73] Assignee: The Whitaker Corporation, Wilmington, Del.

[21] Appl. No.: 960,065

[22] Filed: Oct. 29, 1997

[30] Foreign Application Priority Data

Nov. 12, 1996 [JP] Japan ..... 96402412

[51] Int. Cl.[6] ..... E05B 47/00

[52] U.S. Cl. ..... 70/277; 70/252; 200/43.08

[58] Field of Search ..... 70/277–283, 252, 70/DIG. 30, 395, 408; 200/43.05, 43.06, 43.08

[56] References Cited

U.S. PATENT DOCUMENTS

| | | | |
|---|---|---|---|
| 3,187,123 | 6/1965 | Anthony | 200/43.08 X |
| 3,654,600 | 4/1972 | Yamamoto | 340/52 D |
| 3,660,624 | 5/1972 | Bell | 200/44 |
| 3,703,704 | 11/1972 | Schiesterl et al. | 340/64 |
| 4,326,125 | 4/1982 | Fues | 70/277 X |
| 4,527,024 | 7/1985 | Lai | 200/43.08 X |
| 4,658,105 | 4/1987 | Seckinger | 200/43.05 |
| 4,912,290 | 3/1990 | Tanaka et al. | 200/61.66 |
| 4,924,686 | 5/1990 | Vonlanthen | 70/277 |
| 5,079,435 | 1/1992 | Tanaka | 307/10.2 |
| 5,186,031 | 2/1993 | Janssen et al. | 70/277 |
| 5,398,532 | 3/1995 | Janssen et al. | 70/252 |
| 5,408,062 | 4/1995 | Agnatovech | 70/DIG. 30 X |
| 5,442,943 | 8/1995 | Schremmer et al. | 70/252 |
| 5,551,267 | 9/1996 | Janssen et al. | 70/252 |
| 5,632,168 | 5/1997 | Yano | 70/278 |

FOREIGN PATENT DOCUMENTS

| | | | |
|---|---|---|---|
| 0 278 905-B1 | 7/1988 | European Pat. Off. | E06B 49/00 |

OTHER PUBLICATIONS

British Search Report.

*Primary Examiner*—Suzanne Dino Barrett
*Attorney, Agent, or Firm*—Driscoll A. Nina

[57] ABSTRACT

An electronic key contact assembly for automobiles has a static housing and a rotatable assembly. The rotatable assembly comprises a housing having a key receiving slot and spring terminals. In the Off position, the spring terminals are outwardly biased, where a camming portion thereof is received in a recess of the static housing. Upon turning the key to the On position, the contacts are inwardly biased by engagement of the camming portion with a raised portion of the static housing. Rubbing of the key with the contacts during insertion is thus avoided.

9 Claims, 4 Drawing Sheets

ELECTRICAL IGNITION KEY ASSEMBLY

BACKGROUND OF THE INVENTION

1. Field of the Invention

This invention relates to an assembly for receiving and electrically contacting a key, for example an automobile ignition key.

2. Description of the Prior Art

It is known to provide automotive ignition keys having electrical or electronic circuitry within the key or key receiving assembly, particularly for preventing theft by electronic identification of the key. An example of a conventional key and corresponding key receiving drum is described in U.S. Pat. No. 4,912,290. In this patent, the key is provided with electrical pads that are contacted by resiliently mounted contacts provided in a rotatable key drum.

One of the problems with conventional electronic keys, is that the contact pads on the key rub against the resilient mating contacts mounted in the key drum, possibly leading to impairment of the mechanism due to excessive contact wear.

It would be desirable to overcome this problem. In addition, it would be desirable to provide a contact system that is adapted to contact a key having a particularly simple and cost-effective form. It would be further desirable to provide a connection system that is particularly reliable over the projected lifetime of an automobile.

SUMMARY OF THE INVENTION

The object of this invention is therefore to provide a reliable electrical key connection assembly that is able to withstand a large number of insertion/extraction cycles reliably.

Objects of this invention have been achieved by providing a connection assembly according to claim 1. In particular, a key connection assembly comprises a key drum having a static housing assembly and a rotatable housing assembly mounted therein, the rotatable assembly having a key receiving slot and one or more electrical contacts attached to the rotatable housing and having at least one contact point biasable into the key receiving slot, wherein the contact further comprises a camming portion engageable against a camming surface provided on the static housing, the contact point of the contact positioned out of the key receiving slot when the rotatable assembly is in an Off position, the contact points biasable into the key receiving slot during rotation of the rotatable assembly by action of the contact camming portion against the static housing camming wall. Advantageously therefore, electrical connection between the contacts and key is effected only once the key is inserted in the drum and rotated thereby eliminating rubbing of the contact with the key during insertion.

The contacts may advantageously be provided with a pair of opposed contact points for engaging either side of the key, the contact points curled inwards from a U-shaped base interconnecting the opposed contacts. A simple stamped and formed contact may thus be produced. A pair of identical contacts may be provided at opposed ends of the key slot.

Further advantageous features of this invention will be apparent from the following description, claims or drawings.

DETAILED DESCRIPTION OF THE PREFERRED EMBODIMENT

Figure 1:
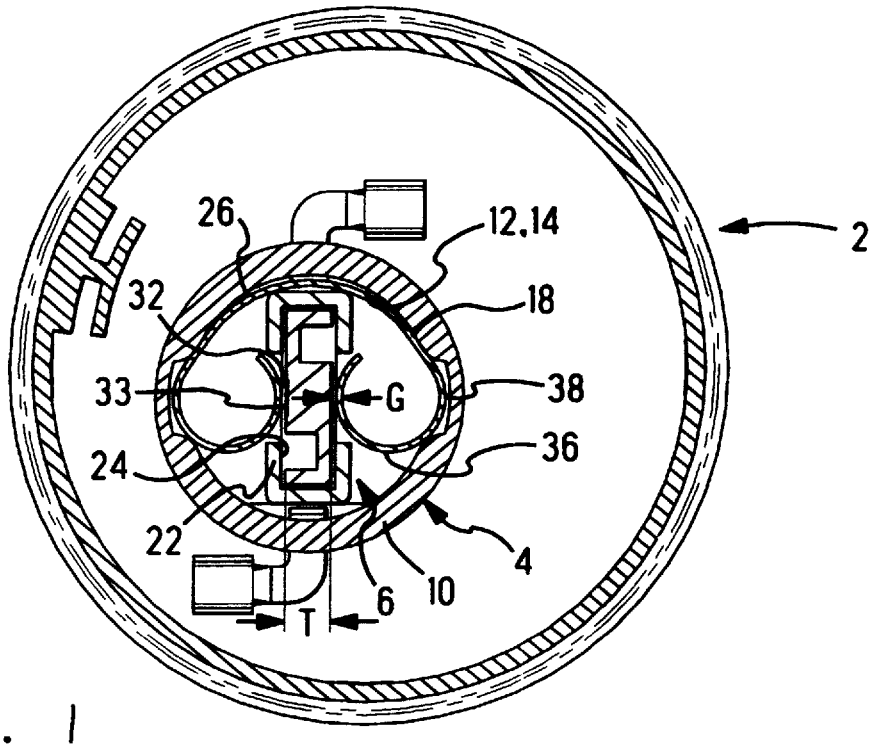
FIG. 1 is a cross-sectional view through a key connection assembly according to this invention in the Off position.

Referring to the Figures, a key connection assembly 2 for connection to a key 1 comprises a static assembly 4 and a rotatable assembly 6. The static assembly 4 comprises a housing 8 having a central cylindrical wall 10 forming a cavity 12 within which the rotatable assembly 6 is rotatably mounted. The wall of the cavity 12 comprises a camming surface 14 having a recessed portion 16 for receiving contacts in the Off position and a raised portion 18 for biasing contacts into the On position.

The rotatable assembly 6 comprises a housing 20 having a central peripheral wall 22 defining a key receiving slot 24 for receiving the shank of the key 1 therein. The assembly 6 further comprises a pair of electrical terminals 26, each of the terminals having a connection section 28 for connection to a conducting wire or complementary conductor, a contact section 30, comprising a pair of opposed contacts 32, and a U-shaped spring base 34 interconnecting the contacts 32. The pair of contacts 32 are provided on curled over ends 36 extending from the spring base 34 such that the contact surfaces 32 face each other. In the unstressed free-standing position, the spring base 34 biases the contacts 32 outwardly to such an extent that the gap between the opposed contacts 32 is greater than the thickness T of the key 1. An outer camming surface 38 is provided where the contact curl 36 joins the spring base 34 at outermost points substantially at the level of the contact surfaces 32 i.e. proximate a line that extends through the opposed contact points 32.

Figure 5:
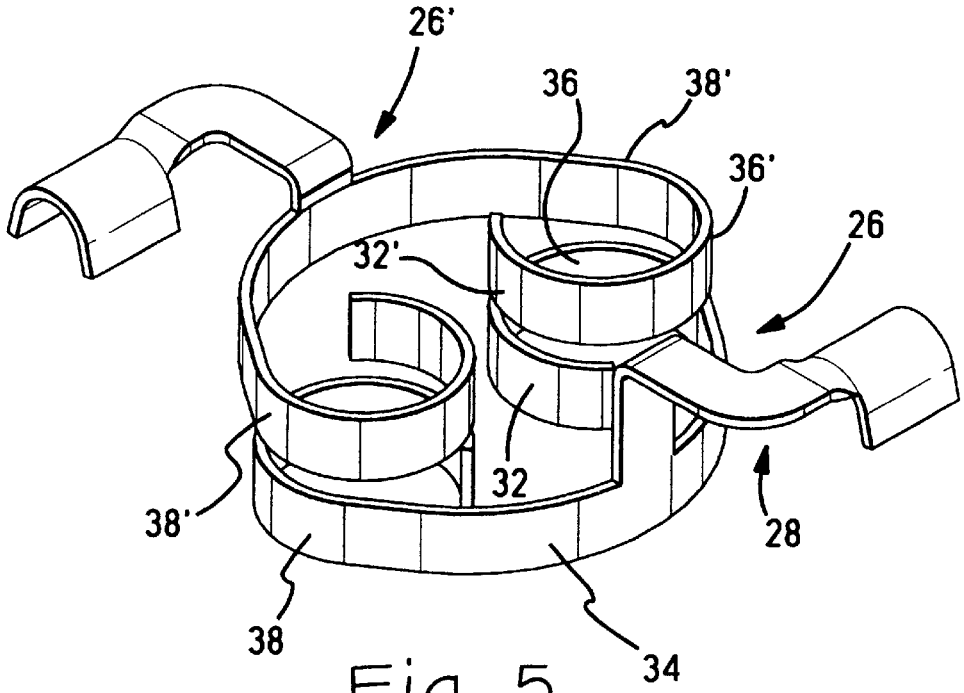
FIG. 5 is an isometric view of a pair of contacts of the connection assembly.
Figure 6:
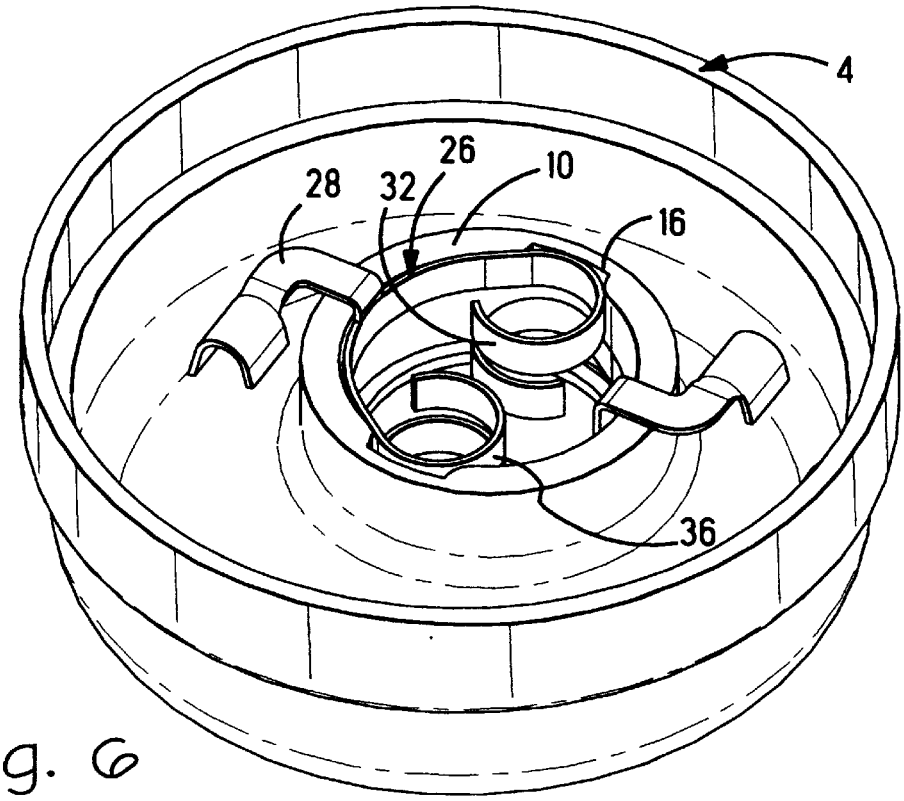
FIG. 6 is an isometric view of the contacts within a static housing.
Figure 7:
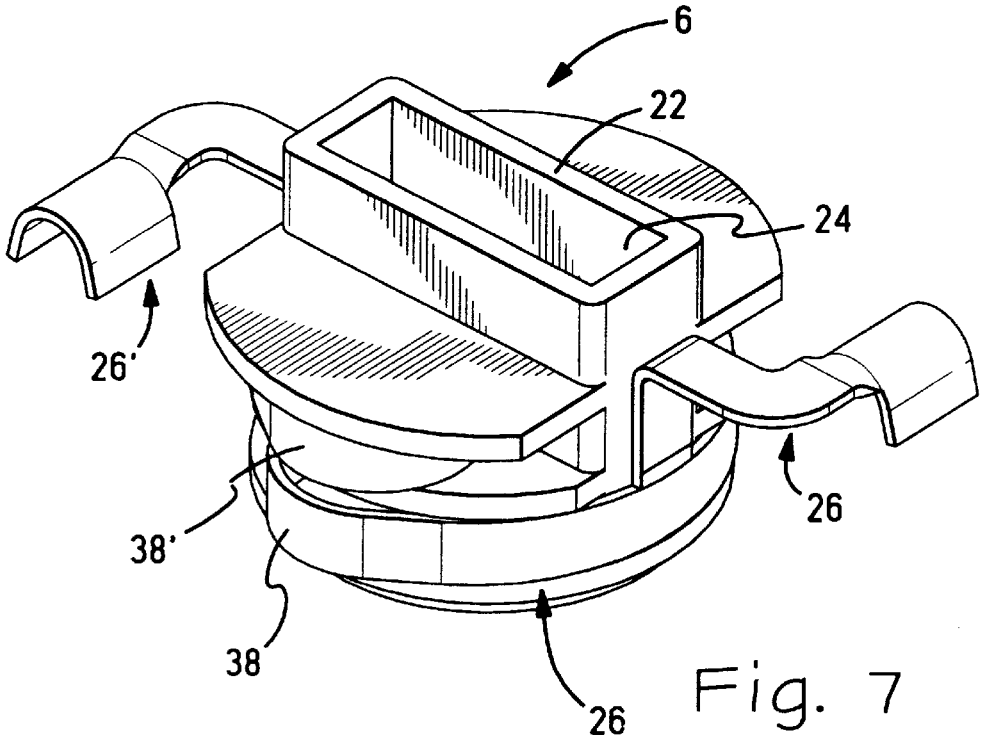
FIG. 7 is an isometric view of the contacts mounted on a rotatable housing.
Figure 8:
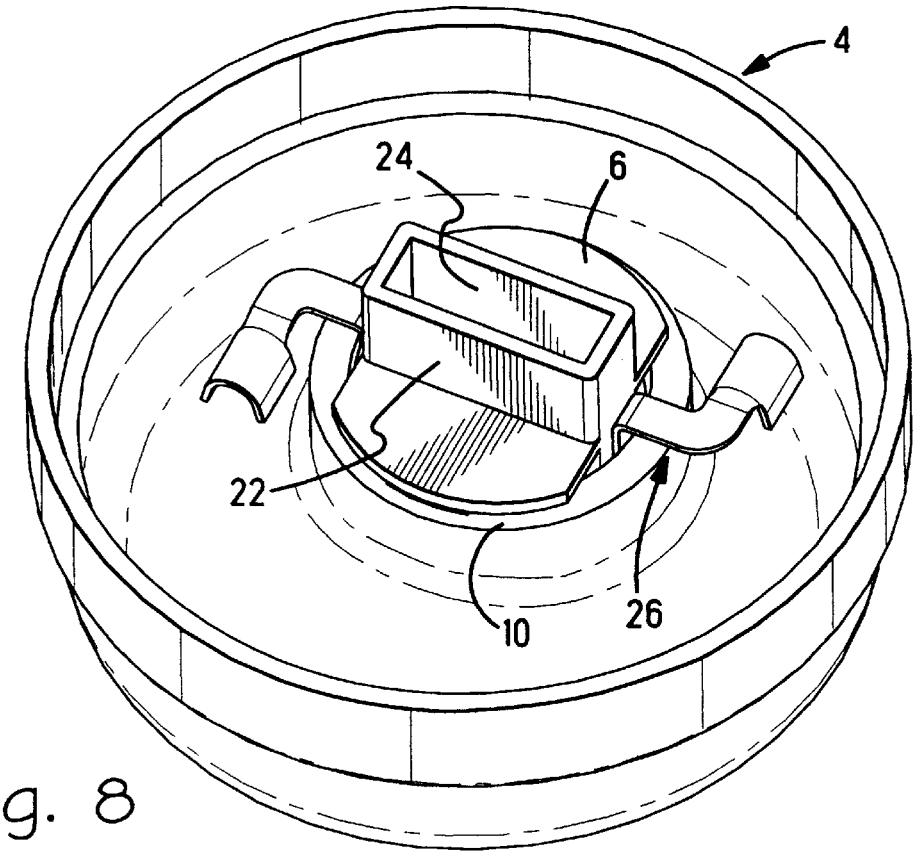
FIG. 8 is an isometric view of the rotatable housing and contacts mounted in the static housing.

As best seen in FIG. 5, a pair of substantially identical terminals 26,26' may be provided, one above the other in the direction of insertion of the key 1 (direction I) on opposed sides. The latter enables a single contact design to be provided for both contacts in order to reduce manufacturing costs.

Figure 2:
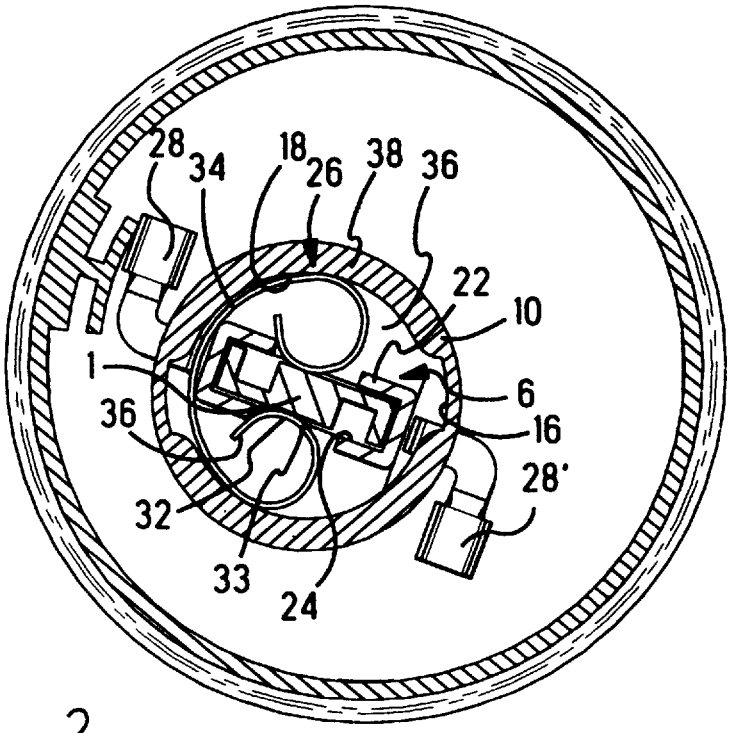
FIG. 2 is a similar view to FIG. 1 of the connection assembly in the On position.
Figure 3:
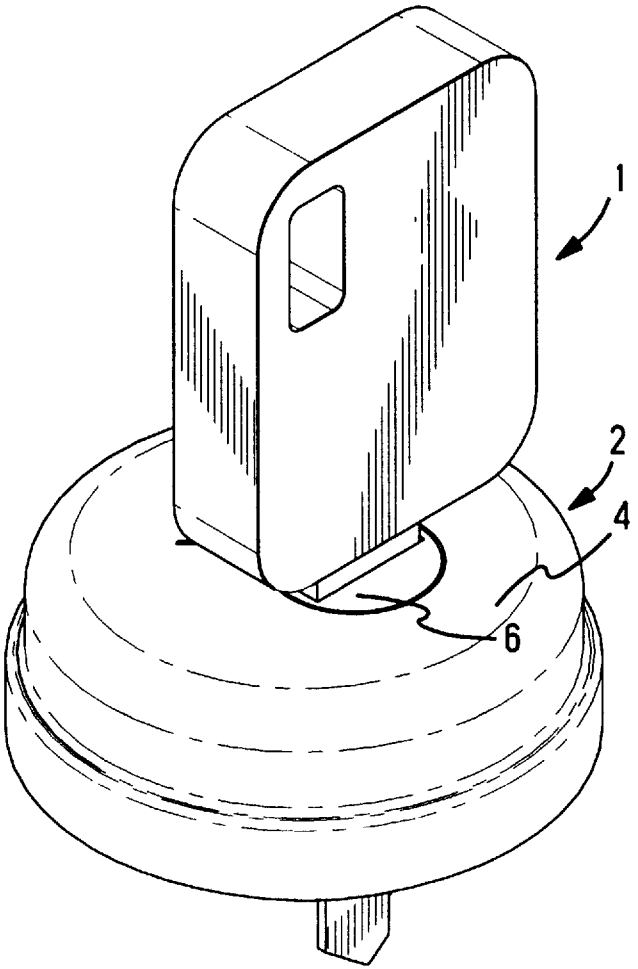
FIG. 3 is an isometric view of a key received in a connection assembly according to this invention.
Figure 4:
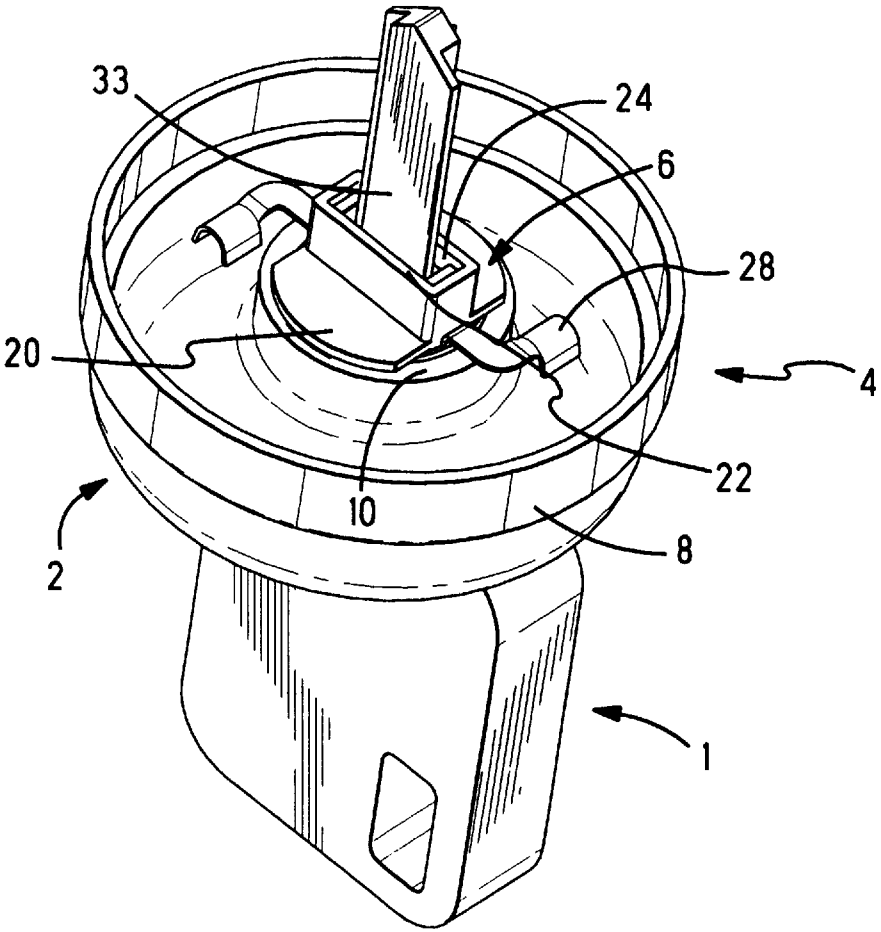
FIG. 4 is an isometric view of the underside of the assembly according to FIG. 3.

As best seen in FIG. 1, in the Off position, the contact camming portions 38 bias into the static housing camming recess 16 whereby the contact points 32 are separated from the key side surface 33 by a small gap G. The key 1 can thus be inserted into the key receiving slot 24 without touching the contact points 32, thereby preventing contact wear. Upon rotation of the rotatable assembly 6 by turning the key 1, the contacts 26 which are attached to the rotatable housing 20 rotate with respect to the static housing cavity 12. As shown in FIG. 2 the contact camming portions 38 are biased inwardly towards the key side surfaces 33 by camming against the cavity raised portions 18. The curled portions 36 of the contacts store elastic energy for producing reliable contact pressure against the key.

Due to the opposed contact points 32 interconnected by the spring base 34, contact pressure on either side of the key is optimally distributed for reliable contact therewith. The simple construction of the spring base and curled contact ends may be stamped and formed from sheet metal. The latter enables provision of a particularly cost-effective, reliable and simple contact.

We claim:

1. A key connection assembly comprising a static housing assembly, and a rotatable housing assembly mounted rotatably therein, the rotatable assembly having a key receiving slot and one or more electrical terminals attached to the rotatable housing and having at least one contact surface biasable into the key receiving slot, wherein the terminal further comprises a camming portion engageable against a camming surface provided on the static housing, the contact surface of the terminal positioned out of the key receiving slot when the rotatable assembly is in an Off position, the contact surface biasable into the key receiving slot during rotation of the rotatable assembly by action of the terminal camming portion against the static housing camming wall when the rotatable assembly is rotated to an On position.

2. The connection assembly of claim 1 wherein the terminal camming portion is received in a recess in peripheral wall of the static housing that surrounds the key receiving slot when in the Off position.

3. The connection assembly of claim 2 wherein the peripheral wall is substantially tubular in shape, the camming surface being formed on the inner surface of the tube.

4. The connection assembly of claim 1 wherein each terminal comprises a pair of opposed contact surfaces for engaging opposite sides of the key.

5. The connection assembly of claim 1 wherein the contact surface is provided on a resilient curled end extending from a spring base of the terminal.

6. The connection assembly of claim 5 wherein each terminal comprises an opposed pair of the curled ends interconnected by the spring base which has a substantially U-shape.

7. The connection assembly of claim 1 wherein the terminal is a single part stamped and formed from sheet metal.

8. The connection assembly of claim 1 wherein a pair of the terminals are provided one above the other with respect to a direction of insertion of the key into the key receiving slot.

9. The connection assembly of claim 8 wherein the pair of terminals are substantially identical but arranged facing each other.

* * * * *